US005513849A

United States Patent [19]

Navin

[11] Patent Number: 5,513,849

[45] Date of Patent: May 7, 1996

[54] METHOD OF PLAYING A FOUR-PLAYER CHESS GAME

[76] Inventor: John J. Navin, 68 S. Mill St., Hopkinton, Mass. 01748

[21] Appl. No.: 513,177

[22] Filed: Aug. 9, 1995

[51] Int. Cl.[6] ..... A63F 3/02

[52] U.S. Cl. ..... 273/261; D21/24

[58] Field of Search ..... 273/261; D21/24

[56] References Cited

U.S. PATENT DOCUMENTS

| | | | |
|---|---|---|---|
| 4,067,578 | 1/1978 | Chang | 273/261 |
| 4,696,478 | 9/1987 | Farrell | 273/261 |
| 4,708,349 | 11/1987 | Shomer | 273/261 |
| 4,778,187 | 10/1988 | Deak, Jr. | 273/261 |
| 4,932,669 | 6/1990 | Perry | 273/261 |
| 5,125,666 | 6/1992 | Adams | 273/261 |
| 5,275,414 | 1/1994 | Stephens et al. | 273/261 |

FOREIGN PATENT DOCUMENTS

| | | | |
|---|---|---|---|
| 1165694 | 10/1958 | France | 273/261 |
| 3520047 | 12/1986 | Germany | 273/261 |
| 3818343 | 12/1989 | Germany | 273/261 |
| 2004289 | 12/1993 | Russian Federation | 273/261 |
| 214636 | 5/1941 | Switzerland | 273/261 |
| 1030519 | 5/1966 | United Kingdom | 273/261 |

OTHER PUBLICATIONS

"Double Chess", Chess Variations by John Gollon, Charles E. Tuttle Company, 1974, pp. 203–208.

*Primary Examiner*—Benjamin H. Layno

[57] ABSTRACT

A method of playing chess for four players has been devised which utilizes a modified chess board and a plurality of distinguishable sets of playing pieces. The game board consists of 160 alternating light-colored and dark-colored squares arranged in the shape of a cross; it has two prominent lines or boundary indicators that intersect at the center of the board. Four sets of conventional chess pieces are used, each set being a different color, and all pieces move according to the standard rules of chess. Pawns may be promoted by advancing six squares to cross the center of the board. Each player defends his/her king against three opponents' pieces while attempting to win the game by capturing any opponents' king which has suddenly become exposed to direct attack or by being the last player to put a checkmated king in "check" before the checkmated player's turn occurs, even if another player initially established the checkmate. A stalemate can also end the game and is scored as a four-way draw.

1 Claim, 1 Drawing Sheet

METHOD OF PLAYING A FOUR-PLAYER CHESS GAME

BACKGROUND OF THE INVENTION

The present invention relates to a method of playing chess for four players which employs chess pieces of four different colors, a cross-shaped game board having 160 alternately-colored squares, two prominent intersecting center lines which are clearly distinguishable from other lines on the playing board, and special rules regarding the promotion of pawns, the conclusion of the game, and the determination of the winning player.

DESCRIPTION OF THE PRIOR ART

The patent bearing Ser. No. 332,334 filed Apr. 3, 1989 ("Method of Playing a Multiple Player Chess Game": U.S. Pat. No. 4,932,669) also requires a cross-shaped game board having 160 alternately-colored squares. However, that game board and methodology have the following significant differences from the present application:

1) that game board does not have any separate or prominent intersecting lines at the center of the board nor any function attached thereto, whereas the present application has both
2) that game methodology does not allow for the promotion of pawns at the center of the board whereas the methodology outlined in the present application has such a rule as a principal feature
3) that game methodology allows pawns, after capturing an opponent's piece, to advance "in a second direction 90 degrees from the first direction" whereas the present application does not allow any such deviation from the conventional manner in which pawns advance
4) that game methodology allows that "when a player's king is checkmated, regaining playing pieces of the player's can move to evade capture without the power of capture," whereas the present application allows no such continuation of play after a player's king is checkmated
5) that game methodology does not have (i.e., the patent does not state) any special rules pertaining to the method by which a single winner is determined and the game concluded, whereas the present application has explicit rules regarding the moment at which the game ends and the exact circumstances by which the winner is determined
6) that game methodology does not distinguish whether or not each player has playing pieces of a distinctive color, making it impossible to know whether the game methodology is intended to be played by teams (i.e., on a partner basis) or whether each player battles three opponents, whereas the present application describes a methodology for a four-player chess game that is clearly intended to be contested on an individual (not a team or partner) basis by players having pieces of a distinctive color
7) that game methodology does not allow (i.e., the patent does not state) a king to be captured outright during the course of play whereas the present application allows for such a possibility
8) that game methodology does not allow (i.e., the patent does not state) the conventional chess rule regarding "en passant" to be altered, whereas the present application allows a pawn to capture certain opposing pawns advancing on its flank by virtue of an alteration in conventional chess rule regarding "en passant"

The patent bearing Ser. No. 481,777 filed Jun. 21, 1974 ("Foursided Chess Game": U.S. Pat. No. 4,147,360) also requires a cross-shaped game board having alternately-colored squares. However, that game board and methodology has the following significant differences from the present application:

1) that game board has 260 squares with four outer rows of ten squares across on each side of the board whereas the present application describes a method of play that utilizes a game board having only 160 squares and Just three outer rows of eight squares across on each side of the board
2) that game board has two intersecting diagonal lines which "serve as reference indicators for perpendicular piece movement into adjacent sub-sections" whereas the present application describes a method of play in which the game board has two intersecting horizontal and vertical lines which serve to Identify where pawns are promoted and have no function related to piece movement
3) that game methodology, as described, bears no similarity to the game methodology outlined in the present application On Nov. 11, 1994, the inventor of the present application, John Joseph Navin, applied for a design patent of the game board as described in the present Utility patent application. That application (Ser. No. 29/031,167) was rejected under 35 U.S.C. 103 as being unpatentable over Jones, in view of Preston.

On Nov. 23, 1994, the inventor of the present application, John Joseph Navin, applied for copyright registration of an unpublished work entitled "Extreme Chess: Rules & Strategy" which outlined the game playing methodology described in the present application. A certificate of registration has been issued by the Copyright office (TXu 669–372) with an effective date of registration of Nov. 23, 1994.

SUMMARY OF THE INVENTION

The present invention is a method of playing a four-player chess game which enables each of four players to compete simultaneously against three other individuals (unlike four-way chess games that involve partners or team play). Although it uses an unconventionally shaped board having 160 squares, it adheres to the traditional rules of chess in terms of the type add number of pieces per player and the manner in which the pieces move and capture, so the game can be learned very quickly by experienced chess players. The board design, the special rules regarding promotion of pawns at the center of the board, end the manner by which the winner of the game is determined (i.e., the player who captures an opponents king or the last player to put the checkmated king in check) differentiates this method of play from any other four-way chess game.

DETAILED DESCRIPTION OF THE INVENTION

Figure 1:
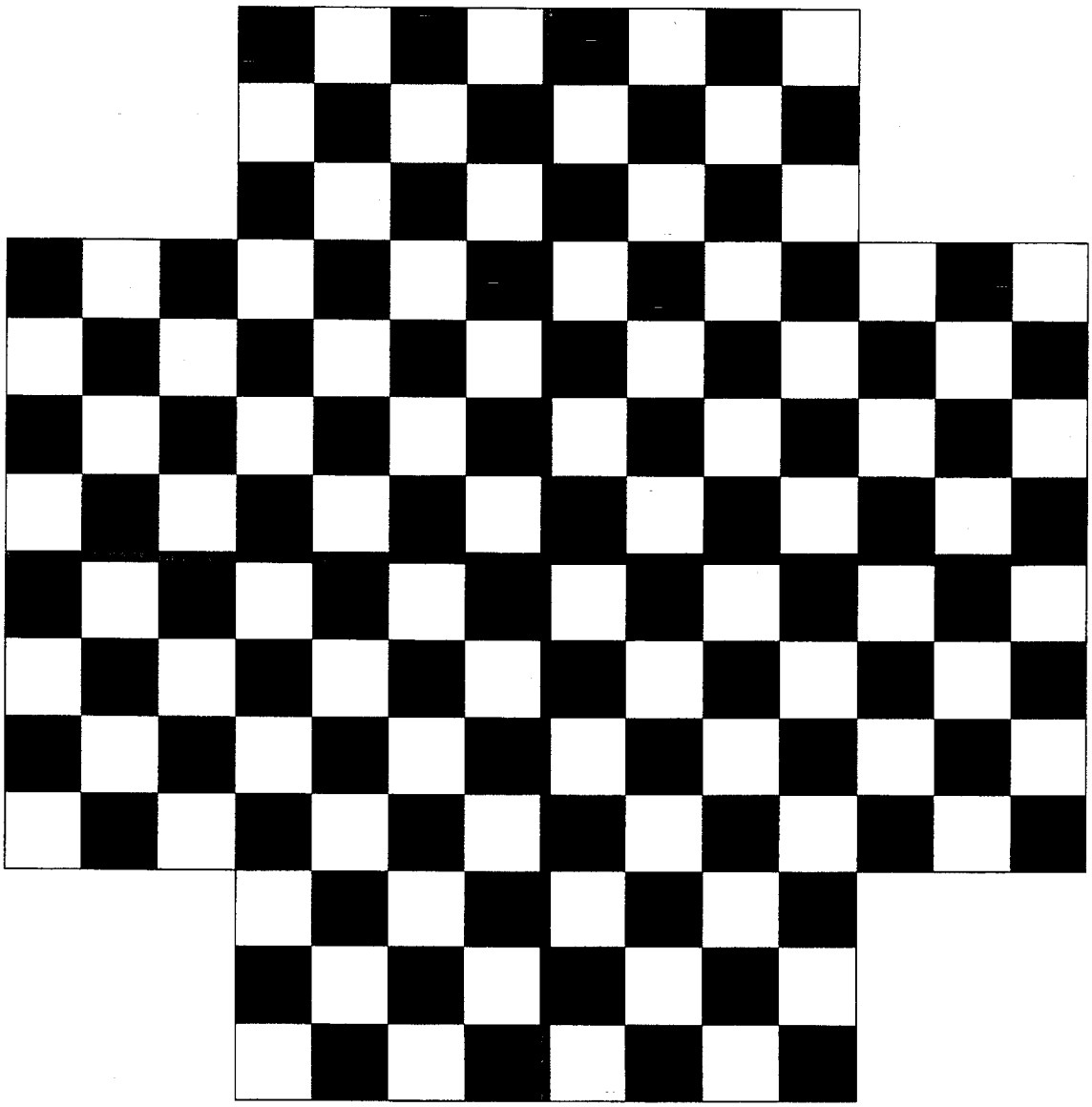
FIG. 1 is a view of the cross-shaped game board employed in conjunction with the present invention which shows the two intersecting boundary indicators which denote where pawns are promoted.

The present invention is a method of playing chess for four players which utilizes a cross-shaped game board as shown in FIG. 1 wherein 80 light-colored squares and 80 dark-colored squares are arranged in an alternating color pattern consistent with the alternating color pattern of traditional chess and checker boards, and all 160 squares of which are arranged in the shape of a cross consisting of a center area of 64 squares and four extensions of 24 squares each, each extension comprised of three rows of eight squares, the outermost two rows of which are occupied by an individual player's 16 pieces at the outset of the game. Said game board includes two solid or shaded lines, rules, or similar boundary indicators that traverse the length and width of the board and intersect at its center, one of which divides the board vertically, having 80 squares to the left and 80 squares to the right, and the other of which divides the board horizontally, having 80 squares above and 80 squares below.

The four-player chess game methodology of the present invention also utilizes a plurality of distinguishable sets of playing pieces, being 64 conventional chess pieces, comprised of four sets of 16 pieces, each set being of a different color or shade from the other three sets, and each set including 1 King, 1 Queen, 2 Bishops, 2 Knights, 2 Rooks, and 8 Pawns, with all pieces of the same set being of the same color or shade, and two sets being of light hue (distinctive from one another) and two sets being of dark hue (distinctive from one another).

The present invention is a method of playing chess for four players whereby each player must defend himself/herself against three opponents while attempting to capture or place any one of three enemy kings in checkmate, and which adheres to the traditional rules of chess in terms of the type and number of pieces per player and the manner in which the pieces move and capture, but which deviates from the traditional rules of chess in the following ways:

1) Pawns may be promoted when they advance six squares forward and cross the center of the board as indicated by one of the two intersecting solid or shade lines or boundary indicators which is perpendicular to the forward direction of movement of the crossing pawn. Due to the cross-shaped pattern of the board, a player can conceivably advance a pawn (through a series of captures) to the end row (or rank) of the player to his/her left or right. However, no promotion occurs until the pawn crosses the center of the board as indicated by one of two intersecting solid or shade lines or boundary indicators which is perpendicular to the forward direction of movement of the crossing pawn.

2) The game ends when any one of the four players is in checkmate when it is his/her turn to move, but not until then. Until that player's turn arrives, other players continue to take their turns in succession. This sometimes enables players to "steal the checkmate" as described below, or to sabotage the checkmate of an opponent's king (thereby preventing another contestant from winning the game) by capturing the piece that holds a king in checkmate, or by "blocking" the line of attack, or by sacrificing one of their own pieces to create an escape route for the king.

3) The winner of the game is the last player to put the checkmated king in check before the checkmated player's final turn occurs, even if another player initially established the checkmate. Thus, even though Player #1 may have put Player #4 (the player to his/her right) in checkmate, Players #2 or #3 could "steal" the checkmate and claim victory If either one can put Player #4's king in check from another angle on their final move. A player's king could conceivably be held in checkmate by all three opponents when his/her turn arrives, but only the last player to place the king in check wins the game.

4) If two kings are in checkmate at the same time, the winner of the game is determined by whichever checkmate becomes final first (i.e., when a player whose king is in check has no legal move on his/her turn). A player can even win the game when his/her king is in checkmate. If Player #1 places Player #3 in checkmate, and Player #2 then places Player #1 in checkmate, Player #1 will claim victory as soon as Player #3's turn arrives and the checkmate becomes final. When a player places the opponent to his/her left in checkmate, the game ends as soon as that player's turn occurs because the normal clockwise rotation does not give either of the other players an opportunity to "steal" or sabotage the checkmate.

5) It is possible for a king to become exposed to direct attack and be captured outright, immediately ending the game. If by moving a piece a player inadvertently opens up a direct line of attack between one opponent's queen, bishop or rook and another opponent's king, the attacker can win the game by capturing the king when his/her turn occurs (i.e., if the king is still fully exposed to the attack), even though the king might not be in checkmate. A king cannot be captured outright in regular chess because with just two players, the player whose king is in check would either have the opportunity to make a legal move or the game would end in checkmate before the attacker moves again.

6) If a player's king is not in check but he/she can make no legal move when his/her turn arrives, a stalemate is declared and the game is scored as a four-way draw, or tie.

7) Each player has pieces of a distinctive color, two of the colors being of light hues and two of the colors being of dark hue. The two players with the light-colored pieces (e.g., white and yellow) always sit opposite (facing) each other, as do the players with dark colors (e.g., black and blue). The board is positioned so that the players with light-colored pieces have a light square in the lower right corner; players with the dark pieces have a dark square in the lower right corner. Queens are placed on their own color (light queens on light squares, dark on dark), always to the left of the king. Each player's king begins the game directly opposite an opponent's queen and on a vertical with the two other opposing queens. White plays first, with play continuing in a clockwise fashion.

8) Pawns can be captured "from behind" (on the diagonal) by opposing pawns on their flank. Although pawns still capture in the same fashion (on the diagonals) as in regular chess, using this methodology add unconventional game board the pawns do not encounter each other head-on, but at right or left angles.

9) The play known as "en passant" can only occur on a player's right or left flank, when an opponent's pawn advances two squares through his/her pawn's area of capture. Unlike regular chess, "en passant" does not come into play for players sitting directly opposite each other because, under this game methodology, pawns become queens when they reach the middle of the board.

10) An illegal move (e.g., moving another piece when the king is in check) must be taken back if it is detected before the (offending) player's next move is completed. All subsequent moves by other players must also be taken back to allow the offending player to make a legal move. If the illegal move is not detected until the offending player has moved a second time, then the illegal move stands and play continues. Should the offending player's second move also discovered to be illegal before his/her next turn, then only the most recent move is taken back and replayed.

We claim:

1. A Method of playing a four-player chess game wherein the game comprises a game board and a plurality of distinguishable sets of playing pieces, said game board consisting of a square main playing area having 64 alternating light-colored squares and dark-colored squares and four extension areas, one extension area located on each side of said square main playing area, and each extension area having 24 alternating light-colored squares and dark-colored squares arranged in three rows of eight squares each, wherein said game board is arranged In the shape of a cross with a total of 160 squares, and said game board containing two boundary indicators that traverse the length and width of the board and intersect at its center, said boundary indicators having indicia clearly distinguishable from the lines defining the squares, one boundary indicator dividing the board vertically into equal left and right halves and the other boundary indicator dividing the board horizontally into equal top and bottom halves, each set of playing pieces comprising conventional chess pieces that include a plurality of pawns, knights, rooks, and bishops as well as king and queen, and each set being of a different color than the other three sets; said method comprising the steps of:

placing playing pieces on the game board in a conventional chess arrangement, except that each queen initially occupies the square to the right of the king of the same color;

placing playing pieces on the game board so that each player's playing pieces occupy a different extension area and so that each player's playing pieces occupy the two rows of squares on the extension area that are located farthest from the square main playing area;

each player, in turn, moving one of their playing pieces from one square on the board to another according to certain restrictions on the movement capabilities of each piece, with white playing first and play continuing in a clockwise fashion; any player during a turn and when desired, moving one of their playing pieces to a square occupied by an opponent's piece and subsequently thereto, removing the opponent's piece as an indication that the opponent's piece has been captured;

each player's pawns being promoted when said pawns advance six squares forward and cross the center of the board as indicated by one of two intersecting boundary indicators which is perpendicular to the forward direction of movement of the crossing pawn;

moving pawns so that they capture on the diagonals in conventional fashion, with the play known as "en passant" in standard chess occurring only on a player's right or left flank, when an opposing player's pawn advances two squares through his/her pawn's area of capture;

each player defending his/her king against three opponents' pieces while attempting to win the game by capturing any one of three enemy kings that suddenly becomes exposed to direct attack by said player's piece, or by placing any one of three enemy kings in checkmate by moving and capturing with said playing pieces, the winner of the game being the last player to put the checkmated king in check;

continuing the steps of moving and capturing until a king becomes exposed to direct attack and is captured, or until any one of the four players is in checkmate when it is his/her turn to move, whereupon the game ends and a winner is declared, but not until then, with other players continuing to take their turns in succession until the checkmated player's turn arrives, thereby affording said players the opportunity to move a piece in such a way as to prevent the checkmate from occurring or to "steal the checkmate" and win the game by becoming the last player to put the checkmated king in check before the checkmated player's final turn occurs, even if another player initially established the checkmate, or until a player can make no legal move when his/her turn arrives but said player's king is not in check, whereupon a stalemate is declared and the game is scored as a four-way draw.

* * * * *